US006336563B1

(12) United States Patent
Floyd, Sr.

(10) Patent No.: US 6,336,563 B1
(45) Date of Patent: Jan. 8, 2002

(54) CUP AND SAUCER HUTCH

(76) Inventor: James L. Floyd, Sr., 11419 Lockwood St., Leesburg, FL (US) 34788

( * ) Notice: Subject to any disclaimer, the term of this patent is extended or adjusted under 35 U.S.C. 154(b) by 0 days.

(21) Appl. No.: 09/513,811

(22) Filed: Feb. 25, 2000

(51) Int. Cl.[7] ..... A47F 7/00
(52) U.S. Cl. ..... 211/70.1; D6/415; D6/467
(58) Field of Search ..... 211/70.1, 71.01, 211/205, 78, 164, 128.1; D6/415, 467, 469, 437, 468, 458, 459, 455, 413; D7/616, 505, 523, 555, 584, 601, 602, 619, 622, 640, 703, 705, 707, 630, 706, 701; 312/198, 107, 280

(56) References Cited

U.S. PATENT DOCUMENTS

| | | | | |
|---|---|---|---|---|
| 750,803 | A | 2/1904 | Bedell | |
| 1,474,281 | A | * 11/1923 | Needler | 211/164 |
| D189,724 | S | 2/1961 | Herrick, Sr. | |
| 3,151,789 | A | * 10/1964 | Schatz | 211/164 |
| D238,405 | S | 1/1976 | Athey | |
| D250,379 | S | 11/1978 | Zahn | |
| D295,351 | S | 4/1988 | Splane et al. | |
| D297,192 | S | 8/1988 | Mixon et al. | |
| D312,556 | S | 12/1990 | Ancona et al. | |
| D332,191 | S | * 1/1993 | Axhamre | D6/458 |
| D334,855 | S | 4/1993 | Harrington et al. | |
| 5,651,595 | A | * 7/1997 | Willis | 312/249.2 |
| D384,554 | S | * 10/1997 | Ancona et al. | D7/505 |

* cited by examiner

*Primary Examiner*—Daniel P. Stodola
*Assistant Examiner*—Erica B. Harris
(74) *Attorney, Agent, or Firm*—Edward M. Livingston, Esq.

(57) ABSTRACT

A cup-and-saucer hutch has a saucer case (1) with a case door (9) for containing a predetermined size and plurality of saucers (2) securely without falling when being carried from-place-to-place for use. A cup-rack post (5) with cup-handle hangers (6) for holding cup handles (7) of cups (8) is projected uprightly from a top of the saucer case. Optionally, a refreshment container (15) can be positioned above the cup-rack post for containing, sweetener, creamer, tea and coffee. The refreshment container can be positioned on a top of the cup-rack post or on pillars (16) extended uprightly from a case top (4).

10 Claims, 3 Drawing Sheets

FIG. 3
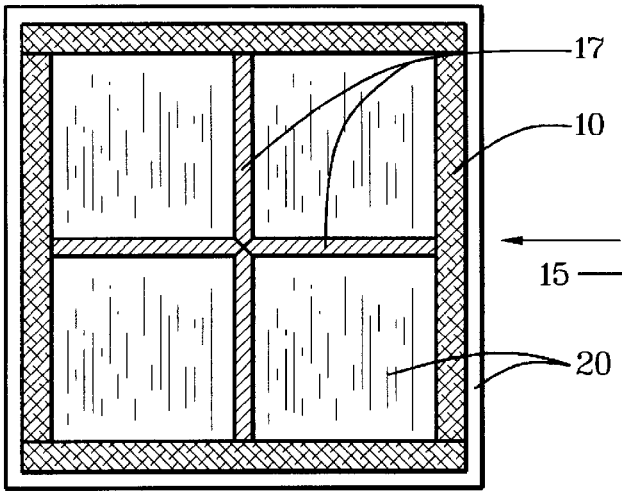
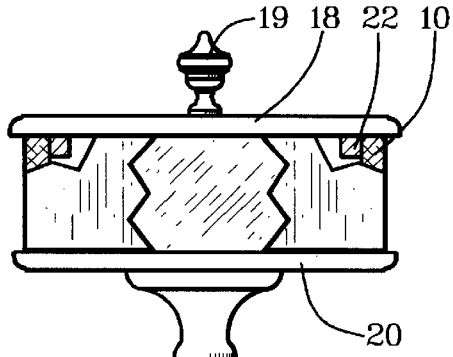
FIG. 4
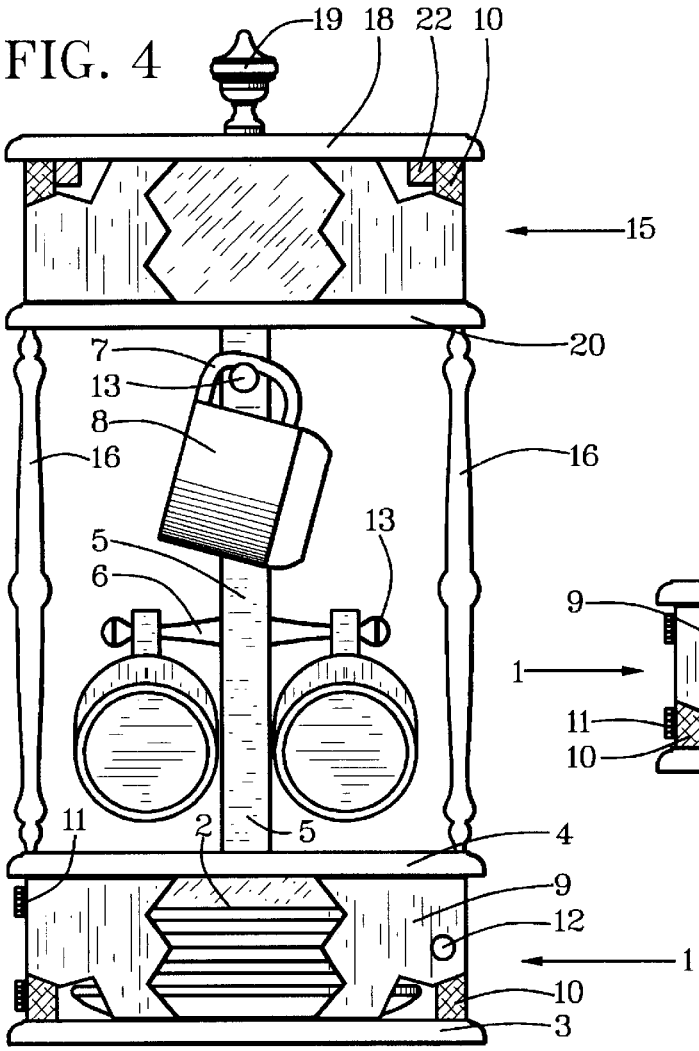
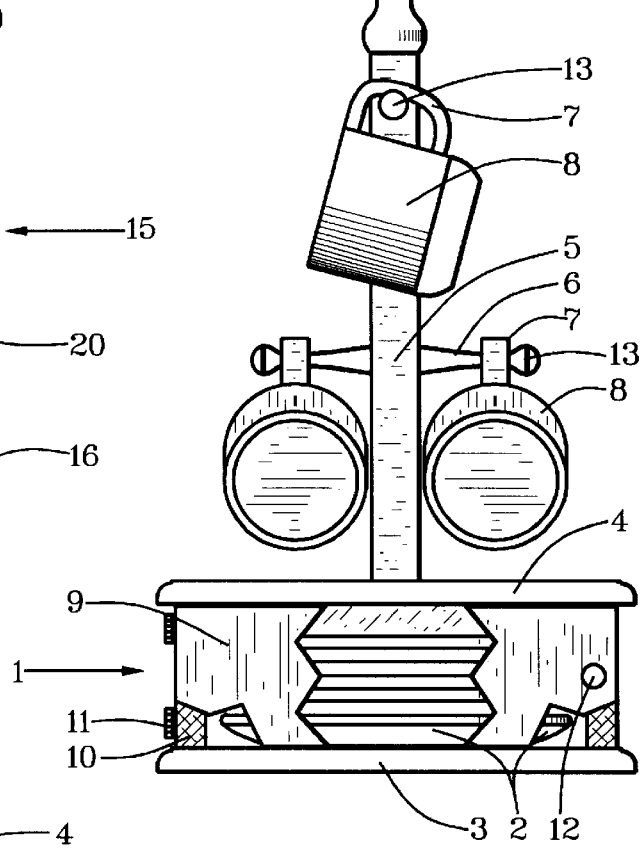
FIG. 5

CUP AND SAUCER HUTCH

BACKGROUND OF THE INVENTION

This invention relates to hutches for holding cups, saucers, coffee and tea.

It is often desirable to carry and to place one or more sets of cups and saucers from-place-to-place for convenient serving of coffee and tea. Often, it is desirable also to carry coffee, tea, sugar and creamer with the sets of cups and saucers.

There are no known hutches for accomplishing these objectives. Different hutches known are mostly designs without utility taught by this invention. Examples of known related but different devices and structures are described in the following patent documents. U.S. Pat. No. Des. 334,855, issued to Harrington, et al. on Apr. 20, 1993, illustrated an earring tree with horizontal bars for holding earrings. U.S. Pat. No. Des. 312,556, issued to Ancona, et al. on Dec. 4, 1990, illustrated a mug tree with a post on a container not structured to contain saucers and without a door to prevent saucers or other objects from falling when being carried from-place-to-place. U.S. Pat. No. Des. 297,192, issued to Mixon, et al. on Aug. 16, 1988, illustrated a display stand for dishware without a door on a saucer hutch and without a post with bars for holding cups. U.S. Pat. No. Des. 295,351, issued to Splane, et al. on Apr. 26, 1988, illustrated a cup and saucer stand without a cupboard with a door for holding saucers. U.S. Pat. No. Des. 250,379, issued to Zahn on Nov. 28, 1978, illustrated a stand with pivotal shelves. U.S. Pat. No. Des. 238,405, issued to Athey on Jan. 13, 1976, illustrated a necktie rack without the cupboard-door feature taught by this invention. U.S. Pat. No. Des. 189,724, issued to Herrick, Sr. on Feb. 7, 1961, illustrated a doughnut holder that was pivotal on a stand. U.S. Pat. No. 750,803, issued to Burnside, et al. on Feb. 2, 1904, described a display rack without the saucer-holding cupboard and doors taught by this invention.

SUMMARY OF THE INVENTION

Objects of patentable novelty and utility taught by this invention are to provide a cup-and-saucer hutch which contains cups and saucers securely on a convenient serving rack for being carried and placed from-place-to-place.

This invention accomplishes these and other objectives with a cup-and-saucer hutch having a shelf for containing a predetermined size and plurality of saucers securely without falling when being carried from-place-to-place for serving. A cup-rack post with cup-handle hangers with retainers for holding cup handles is projected uprightly from a top of the shelf. Optionally, a refreshment container can be positioned above the cup-rack post for containing, sweetener, creamer, tea and coffee. The refreshment container can be positioned on a top of the cup-rack post and on pillars extended uprightly from the case top.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 3 is a top view of a refreshment container for a top of a cup-rack post;

FIG. 4 is a partially cutaway front elevation view of a cup-and-saucer hutch having a refreshment container supported by pillars;

FIG. 5 is a partially cutaway front elevation view of a cup-and-saucer hutch having a refreshment container on atop of the cup-rack post.

DESCRIPTION OF PREFERRED EMBODIMENT

Figure 1:
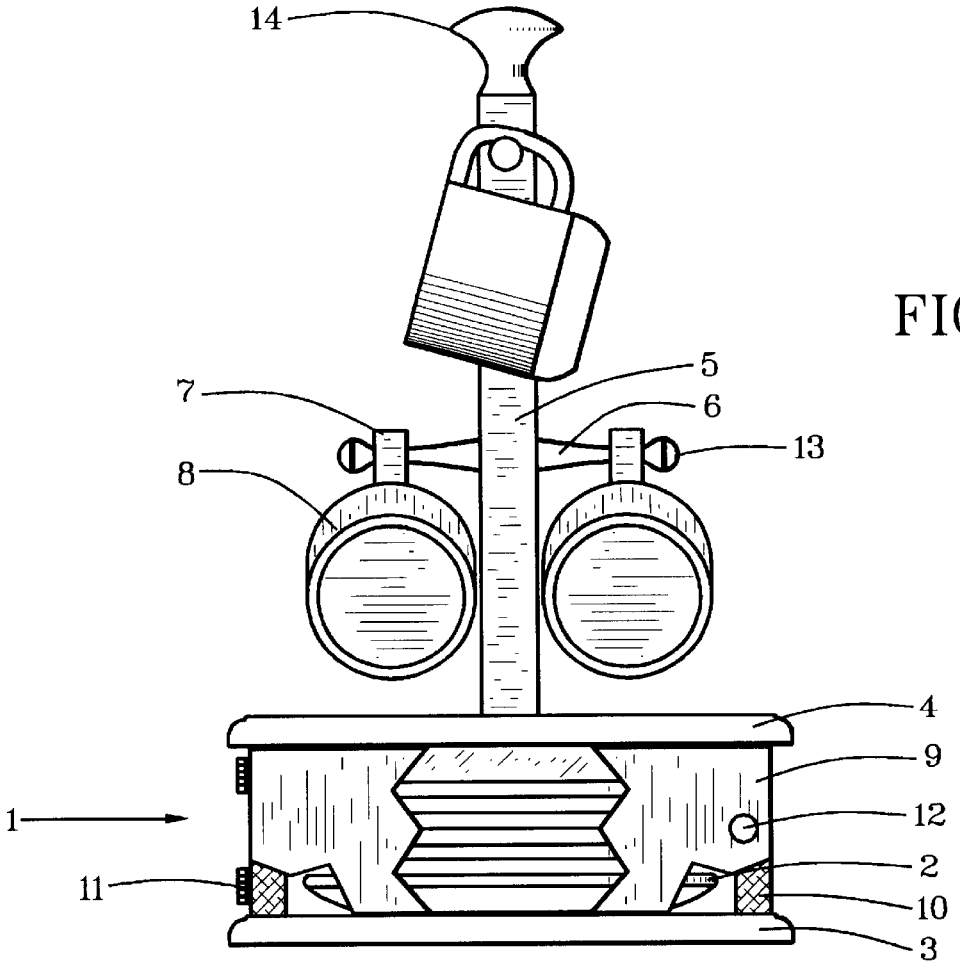
FIG. 1 is a partially cutaway front elevation view of a cup-and-saucer hutch having a cup-rack post.

Listed numerically below with reference to the drawings are terms used to describe features of this invention. These terms and numbers assigned to them designate the same features throughout this description.

1. Saucer case
2. Saucers
3. Case bottom
4. Case top
5. Cup-rack post
6. Cup-handle hangers
7. Handles
8. Cups
9. Case door
10. Walls
11. Hinges
12. Knob
13. Retainer
14. Hutch handle
15. Refreshment container
16. Pillars
17. Partitions
18. Container lid
19. Lid handle
20. Container bottom
21. Post handle
22. Lid rim
23. Carousel
24. Axle Referring first to FIGS. 1–2, a cup-and-saucer hutch has a saucer case 1 sized and shaped to contain a predetermined plurality of saucers 2 stacked vertically intermediate a case bottom 3 and a case top 4. A cup-rack post 5 is extended uprightly from the case top 4. A plurality of cup-handle hangers 6 are extended laterally from the cup-rack post 5 for holding handles 7 of cups 8. A case door 9 in walls 10 of the saucer case 1 prevents the saucers 2 from falling when being carried from-place-to-place for use.

The case door 9 has hinges 11 and a knob 12 to hold it in place.

The cup-handle hangers 6 have retainers 13 to prevent the handles 7 from sliding off when the cup-and-saucer hutch is being carried.

Figure 2:
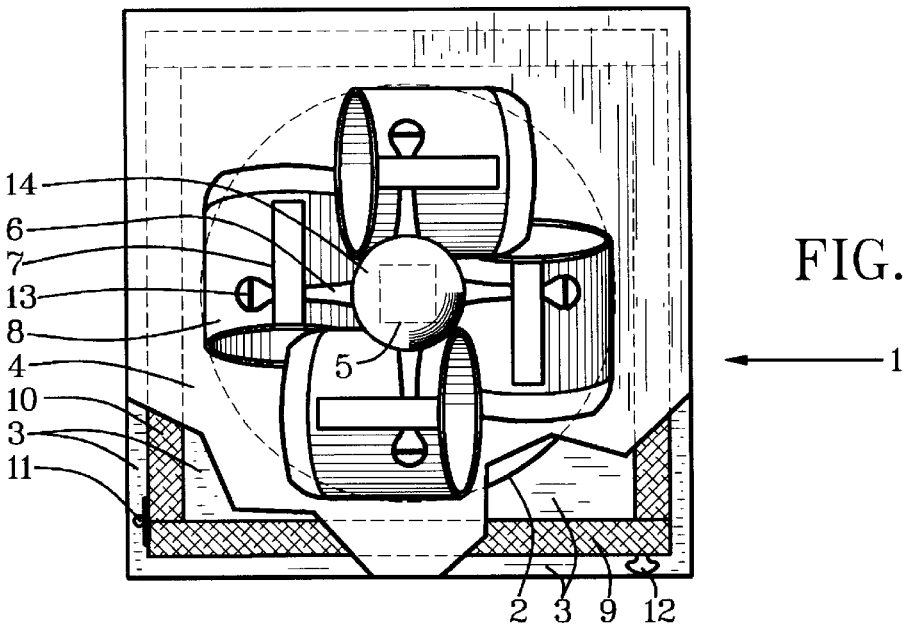
FIG. 2 is a partially cutaway top view of the FIG. 1 illustration.

As depicted in FIGS. 1, 4 and 5, The cup-handle hangers 6 can be extended laterally from the cup-rack post 5 at predetermined heights vertically above the case top 4. Preferably, a first two of the cup-handle hangers 6 are extended laterally from first oppositely disposed sides of the cup-rack post 5 at a first height and a second two of the cup-handle hangers 6 are extended laterally from second oppositely disposed sides of the cup-rack post 5 at a second height vertically above the case top 4.

Further as depicted in FIG. 1, a hutch handle 14 proximate a top of the cup-rack post 5 is used to hand-carry the cup-and-saucer hutch.

Referring to FIGS. 3–5, a refreshment container 15 for containing coffee, tea, sweetener, creamer and other items can be positioned on a top of the cup-rack post 5 where it can be supported optionally also by pillars 16. Partitions 17 in the refreshment container 15 can be provided for separating refreshment items which are not shown. A container lid 18 with a lid handle 19 can be provided.

The refreshment container 15 can have a container bottom 20 that is supported by a post handle 21. A lid rim 22 can be employed to keep the container lid 18in position between walls 10.

The FIG. 5 embodiment is particularly suited for construction with either wood or plastic. The refreshment container 15 can be slightly smaller to compensate for additional height and still have stability.

Figure 6:
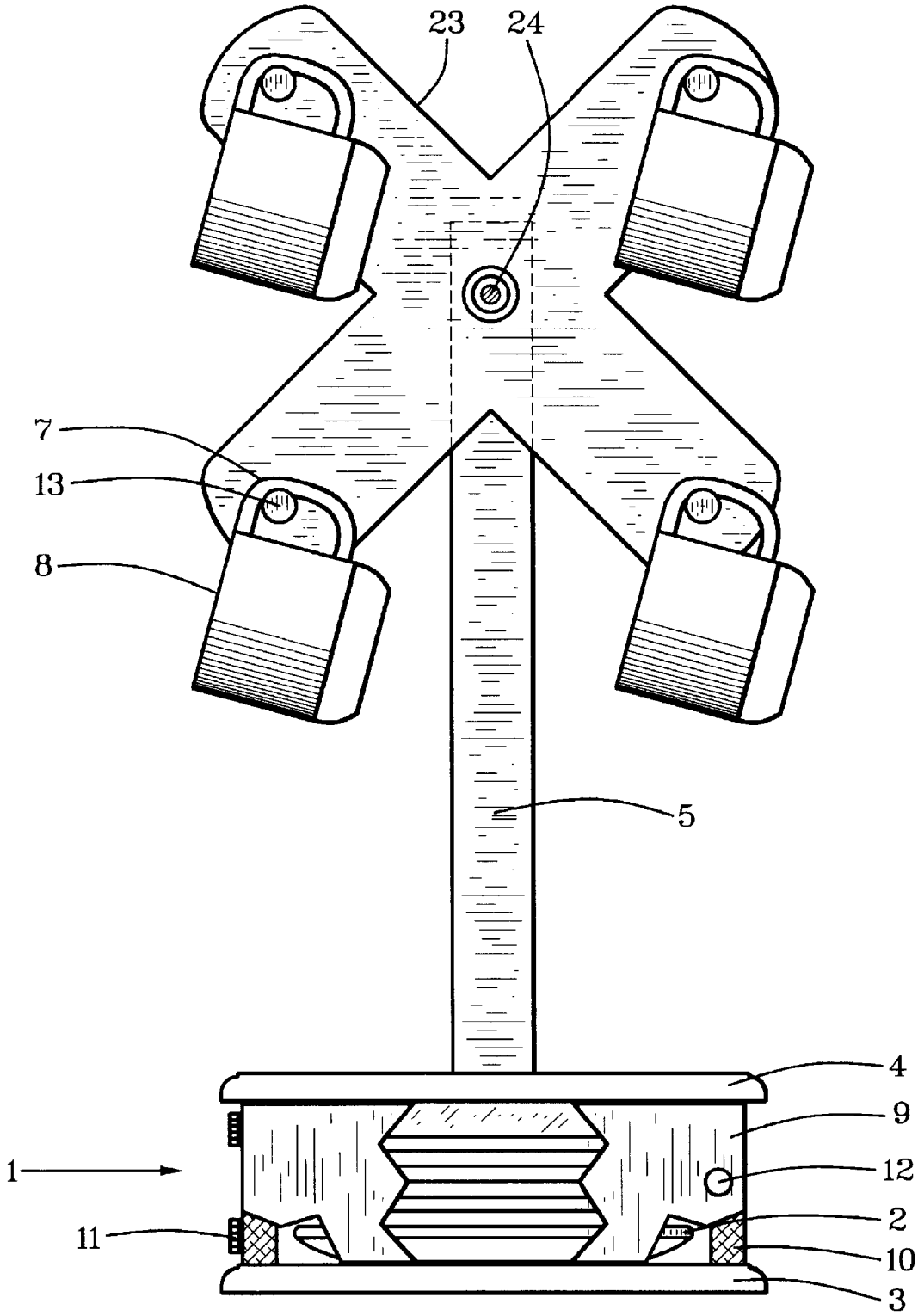
FIG. 6 is a partially cutaway side view of a cup-and-saucer hutch having cup-handle hangers extended from a carousel positioned on an axle extended laterally from the cup-rack post.

Referring to FIG. 6, the cup-handle hangers 6 can be extended laterally from a carousel 23 which is rotatable on an axle 24 extended laterally from the cup-rack post 5.

A new and useful cup-and-saucer hutch having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A cup-and-saucer hutch comprising:

a saucer case having a case bottom, a case top and walls between peripheries of the case bottom and the case top, said saucer case adapted to contain a predetermined plurality of saucers stacked vertically intermediate the case bottom and the case top;

a case door in walls of the saucer case;

a cup-rack post extended uprightly from the case top;

a plurality of cup-handle hangers with retainers supported laterally by the cup-rack post for holding handles of cups; and a hutch handle proximate a top of the cup-rack post.

2. The cup-and-saucer hutch of claim 1 and further comprising: a refreshment container on the top of the cup-rack post.

3. The cup-and-saucer hutch of claim 2 wherein:

the refreshment container has a removable top for protection of sweetener, creamer, coffee and tea.

4. The cup-and-saucer hutch of claim 2 wherein:

the refreshment container is supported by pillars extended from the case top.

5. The cup-and-saucer hutch of claim 2 wherein:

the refreshment container has partitions for separating refreshment items.

6. The cup-and-saucer hutch of claim 1 wherein:

the cup-handle hangers are positioned on a carousel which is rotatable on an axle extended laterally from the cup-rack post.

7. The cup-and-saucer hutch of claim 1 wherein:

the cup-handle hangers are extended laterally from the cup-rack post.

8. The cup-and-saucer hutch of claim 1 wherein:

the cup-handle hangers are extended laterally from predetermined sides of the cup-rack post.

9. The cup-and-saucer hutch of claim 1 wherein:

the cup-handle hangers are extended laterally from predetermined sides of the cup-rack post at predetermined heights vertically above the case top.

10. The cup-and-saucer hutch of claim 9 wherein:

a first two of the cup-handle hangers are extended laterally from first oppositely disposed sides of the cup-rack post at a first height vertically above the case top; and a second two of the cup-handle hangers are extended laterally from second oppositely disposed sides of the cup-rack post at a second height vertically above the case top.

* * * * *